United States Patent [19]

Wachi

[11] 4,416,179

[45] Nov. 22, 1983

[54] ELECTRONIC MUSICAL INSTRUMENT

[75] Inventor: Masatada Wachi, Hamamatsu, Japan

[73] Assignee: Nippon Gakki Seizo Kabushiki Kaisha, Tokyo, Japan

[21] Appl. No.: 370,177

[22] Filed: Apr. 21, 1982

[30] Foreign Application Priority Data

Apr. 23, 1981 [JP] Japan ..... 56-60609

[51] Int. Cl.[3] ..... G10H 1/02

[52] U.S. Cl. ..... 84/1.19; 84/1.01; 84/DIG. 9; 364/724

[58] Field of Search ..... 84/1.01, 1.19, DIG. 9, 84/1.24; 364/723, 724

[56] References Cited

U.S. PATENT DOCUMENTS

| | | | |
|---|---|---|---|
| 3,956,960 | 5/1976 | Deutsch | 84/1.19 |
| 4,018,121 | 4/1977 | Chowning | 84/1.01 |
| 4,085,644 | 4/1978 | Deutsch et al. | 84/1.01 |
| 4,101,964 | 7/1978 | Betts | 364/723 |
| 4,175,464 | 11/1979 | Deutsch | 84/1.19 |
| 4,192,210 | 3/1980 | Deutsch | 84/1.19 |
| 4,211,138 | 7/1980 | Deutsch | 84/1.19 |
| 4,258,602 | 3/1981 | Niimi | 84/1.22 X |
| 4,267,761 | 5/1981 | Deutsch | 84/1.19 |
| 4,300,434 | 11/1981 | Deutsch | 84/1.19 |
| 4,301,704 | 11/1981 | Ragai | 84/1.22 |
| 4,351,218 | 9/1982 | Deutsch | 84/1.19 |

OTHER PUBLICATIONS

"High Quality Parcor Speech Synthesizer" by Sampei Asada et al., IEEE Transactions on Consumer Electronics, vol. CE-26, Aug. 1980.

*Primary Examiner*—F. W. Isen

*Attorney, Agent, or Firm*—Thompson, Birch, Gauthier & Samuels

[57] ABSTRACT

An electronic musical instrument comprising a tone generator, an accumulator and a digital filter. The tone generator generates musical tone signals each represented by sampled values, corresponding to depressed keys. The accumulator accumulates the sampled values of the musical tone signals at predetermined timings. The digital filter modifies an output of the accumulator in accordance with the amplitude-frequency characteristic of a predetermined formant characteristic. A musical tone is produced based on an output of the digital filter circuit, thereby the formant characteristic is imparted to the musical tone.

This utilization of the digital filter for the musical instrument makes it possible to impart a formant characteristic to a musical tone without a complex circuit construction. Moreover the insertion of the accumulator following the tone generator makes it possible to use the digital filter of a low speed type.

11 Claims, 7 Drawing Figures

ELECTRONIC MUSICAL INSTRUMENT

BACKGROUND OF THE INVENTION

This invention relates to an electronic musical instrument, more particularly an electronic musical instrument of the type wherein a musical tone having a fixed formant characteristic and corresponding to a plurality of keys operated at a keyboard is digitally formed.

In prior art electronic musical instruments musical tones are formed by a frequency division method, a harmonic synthesizing method or a modulation method. However, where a musical tone having a fixed formant characteristic, for example, a wind instrument tone or a human voice is to be produced with these method, it is necessary to use a complicated and expensive electrical circuit.

To solve these problems, it has been proposed to modify harmonic coefficients corresponding to respective keys for producing a musical tone having a fixed formant characteristic as disclosed in U.S. Pat. No. 3,956,960.

With this system, however, it is necessary to modify the harmonic coefficients to be produced according to the depressed keys. In above patent it has been implemented to eliminate, attenuate or accentuate certain harmonic components to generate approximately a musical tone having an ideal fixed formant characteristic.

SUMMARY OF THE INVENTION

Accordingly, it is an object of this invention to provide an improved electronic musical instrument having a simple and inexpensive construction and capable of producing a musical tone having a fixed formant characteristic without requiring key scaling.

Another object of this invention is to provide a novel electronic musical instrument capable of producing a musical tone having a fixed formant characteristic by utilizing a low speed digital filter.

Still another object of this invention is to provide an electronic musical instrument having multitone colors and fixed formant characteristics by utilizing an integrated circuitized digital filter which is used on a time division basis.

Briefly stated, according to this invention a digital filter is used to obtain a musical tone of a fixed formant characteristic. Generally, as a digital filter contains therein a multiplier, a definite processing time is necessary for the operation of the filter. Accordingly, mere substitution of a digital filter for a prior art analog filter results in the following problems. More particularly, in an electronic musical instrument of the tone production assignment type where each tone production channel is constructed as a time division tone production channel (time division slot time), and where a tone source waveform corresponding to a depressed key assigned to each tone production channel is outputted, on a time division basis, from a tone source device (time division time slot), the channel timing of each tone production channel is extremely high speed (for example one microsecond). Therefore when a time division tone source waveform is applied directly to the digital filter from the tone source device, the digital filter is required to operate at an extremely high speed so that the digital filter becomes expensive. For this reason, according to this invention, an accumulator is interposed between the tone source device and the digital filter to accumulate the time divisioned musical tone signal from the tone source device at a predetermined period (an interval during which the time division timing of each tone production channel completes one cycle) so as to convert the musical tone signal into a low speed signal which is then applied to the digital filter. The object of this invention is to obtain a musical tone having a fixed formant characteristic. By synthesizing the musical tone signals representing a number of depressed keys and then applying them to the digital filter the object is attained.

According to this invention there is provided an electronic musical instrument comprising a key switch circuit having a plurality of key switches corresponding to a plurality of keys of the musical instrument; a tone source circuit for producing time divisioned and multiplexed musical tone signals to be produced, each of which is represented by sampled values of the musical tone signals, corresponding to respective depressed keys; an accumulating circuit for accumulating the sampled values of the time divisioned and multiplexed musical tone signals at predetermined timings; a digital filter circuit for modifying an output of the accumulating circuit in accordance with a predetermined characteristic; and a musical tone forming circuit for forming a musical tone based on an output of the digital filter circuit.

DESCRIPTION OF THE PREFERRED EMBODIMENTS

Figure 1:
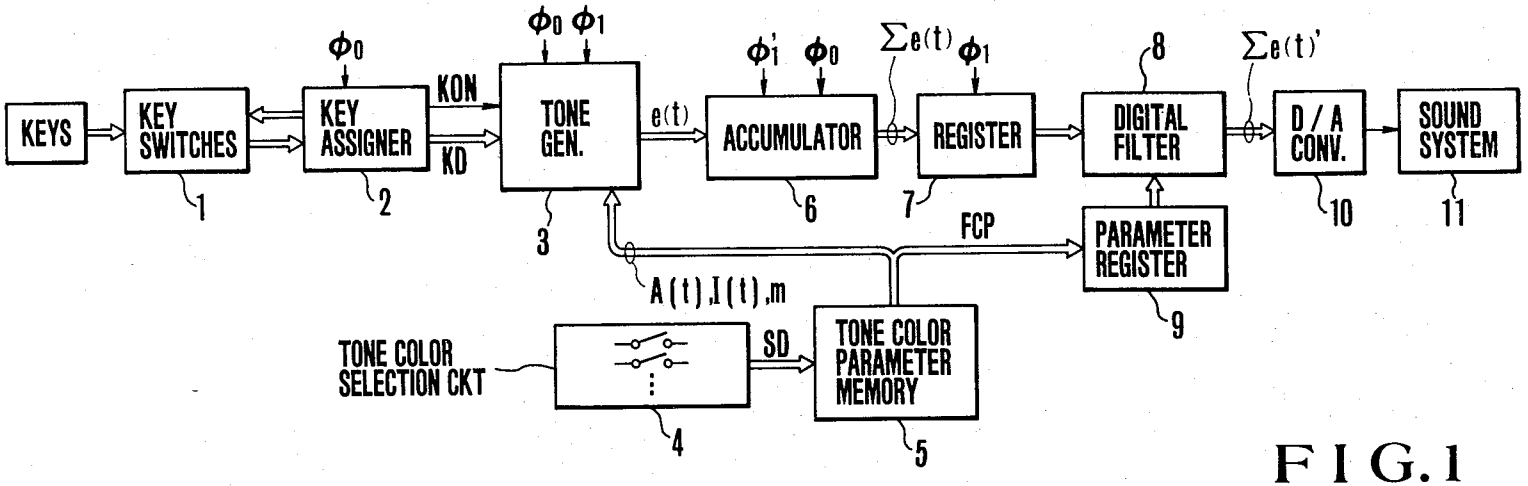
FIG. 1 is a block diagram showing one embodiment of the electronic musical instrument according to this invention.
Figure 2:
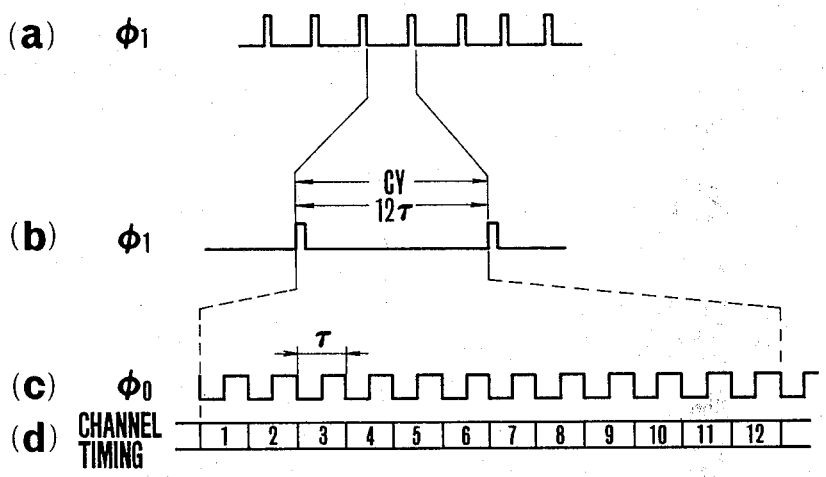
FIG. 2 is a diagram showing one example of the timing signals utilized in the embodiment shown in FIG. 1.

In the embodiment of this invention shown in FIG. 1, a tone source device (tone generator) is provided with 12 tone production channels CH1 through CH12 so that it can form tone source waveforms representing a maximum of 12 depressed keys.

In FIG. 1, a keyboard circuit 1 is provided with a plurality of key switches operated when associated keys of a keyboard are depressed. The ON and OFF states of respective key switches are detected by a key assigner 2. The key assigner detects which one of the keys has been depressed according to the ON or OFF state of the key switch of the keyboard circuit 1, produces a key data KD representing the detected depressed key and assigns a tone production of a musical tone based on the key data KD to either one of the tone production channels CH1 through CH12. In this case, the key data KD is outputted in synchronism with a channel timing corresponding to a tone production channel where the tone production is assigned. The key data KD comprises a note code NC representing the note name of the depressed key and an octave code OC representing an octave range, and is supplied to a tone generator 3 together with on key-on signal KON showing that a given key is now being depressed.

The tone generator 3 comprises 12 tone production channels CH1 through CH12 for forming musical tone signal represented by sampled values. When supplied with the key data in synchronism with the channel timings corresponding to the tone production channels, the tone generator 3 forms a musical tone signal represented by a sample value corresponding to the supplied key data KD and outputs the sampled value in synchronism with a given channel timing. In this case, the tone production channels CH1 through CH12 correspond to respective time divisioned time slots when a single musical tone signal forming circuit is used on the time division basis in 12 time divisioned time slots in one musical tone signal forming cycle CY. As shown by FIG. *2c*, each time divisioned time slot is defined by one period $\tau$ of a clock pulse $\phi_o$, whereas the musical tone signal forming cycle CY is defined by a clock pulse $\phi_1$ having period $12\tau$ which is 12 times that of the clock pulse $\phi_1$ as shown in FIG. *2a*. Accordingly, the tone generator 3 produces, on a time division basis, the sampled values of multiplexed musical tone signal representing a maximum of 12 depressed keys in one musical tone signal forming cycle CY. The musical tone signal forming circuit utilized in the tone generator 3 can be constituted with a modulation type musical tone signal forming circuit, for example. More particularly, where a carrier frequency data and a modulation frequency data are represented by $\omega nt$ and $m.\omega nt$ respectively and where an amplitude information and a modulation index information are denoted by A(t) and I(t) respectively, it is possible to construct the musical tone signal forming circuit as the frequency modulation type, the musical tone signal sampled value e(t) thereof can be obtained by the following equation $$e(t)=A(t)\cdot\sin\,[\omega nt+I(t)\cdot\sin m\cdot\omega nt]$$

In this embodiment, the amplitude information A(t), the modulation index information I(t) and the numerical data m determining the ratio between the modulation frequency and the carrier frequency, corresponds to a selected tone color applied from a tone color parameter memory 5 to be described later with the result that the tone generator 3 produces, on a time division basis, multiplexed musical tone signal sampled value e(t) corresponding to the tone pitch of a depressed key and a selected tone color. Such output may be a time divisioned multiplexed output e(t) synthesized by a frequency modulation system disclosed in U.S. Pat. No. 4,301,704 or 4,297,933 or 3,809,786, for example.

The tone color selector 4 includes a selection switch, not shown, which selects either one of a plurality of musical tone colors each having a fixed formant characteristic. When the selection switch selects either one of the tone colors, the tone color selection circuit 4 outputs a tone color selection information SD corresponding to the selected musical tone color. The tone color selection information SD is supplied to the tone color parameter memory 5 which is constituted by a memory device storing a filter characteristic parameter information FCP which determines the amplitude information A(t), the modulation index information I(t), the numerical data m, and the filter characteristic of the digital filter corresponding to each one of the plurality of tone colors. Upon application of the tone color selection information SD, the tone color parameter memory device 5 produces informations A(t), I(t), m, FCP regarding a tone color corresponding to the tone color selection information SD. Among the outputs from the tone color parameter memory device 5, the informations A(t), I(t) and m are applied to the tone generator 3, while the information FCP is supplied to a parameter register to be described later.

The time divisioned and multiplexed musical tone signal sampled value e(t) outputted from the tone generator 3 is supplied to an accumulator 6 which accumulates the sampled values e(t) in one musical tone signal forming cycle CY for producing an accumulated value. Thus, the musical tone signal sampled values e(t) formed in respective tone production channels CH1 through CH12 are accumulated during one musical tone signal forming cycle CY in synchronism with the building up of the clock pulse $\phi_0$ and the accumulted value $\Sigma e(t)$ is set in a register 7 in synchronism with the building down of the clock pulse $\phi_1$ having the same pulse width as the clock pulse $\phi_0$. The accumulated value $\Sigma e(t)$ of the accumulator 6 is reset or cleared at the time of building up of the clock pulse $\phi_1$, slightly lagging the clock pulse $\phi_1$ to prepare for a new accumulating operation in the next musical tone signal forming cycle CY. The accumulator 6 converts the high speed time divisioned and multiplexed musical tone signal sampled value e(t) outputted from the tone generator 3 into a low speed sampled value $\Sigma e(t)$ and then applies the same to a digital filter 8. Thus, the digital filter 8 may be of a low speed type.

Consequently, the accumulator 6 and the register 7 output a value $\Sigma e(t)$ produced by synthesizing the musical tone signal sampled values e(t) of respective tone production channels CH1 through CH12 at each musical tone signal forming cycle, that is at a low speed of 1/12 of the period of the clock pulse $\phi_0$ and the synthesized or accumulated value $\Sigma e(t)$ is applied to the digital filter 8.

The purpose of the digital filter 8 is to apply a frequency characteristic of a fixed formant characteristic corresponding to a selected tone color to the synthesized musical tone signal sampled value $\Sigma e(t)$. In this case, the parameter information FCP of the filter characteristic that determines the frequency characteristic is given by the tone color parameter memory device 5 via the parameter register 9. As a consequence, the digital filter 8 imparts to the synthesized musical tone signal sampled value $\Sigma e(t)$ a frequency characteristic of the fixed formant characteristic corresponding to the selected tone color. The musical tone signal $\Sigma e(t')$ thus imparted with the frequency characteristic of the fixed formant characteristic and outputted from the digital filter 8 is converted into a corresponding analog musical tone signal by a digital-analog converter 10 and then supplied to a sound system 11, thus producing a musical tone of the fixed formant characteristic.

Such digital filter is described in T. Sanpai et al paper entitled "High Quality Parcor Speech Synthesizer", I.E.E.E. Transaction on Consumer Electronics, Vol. CE-26, Aug. 1980, pp 353–359.

Figure 3:
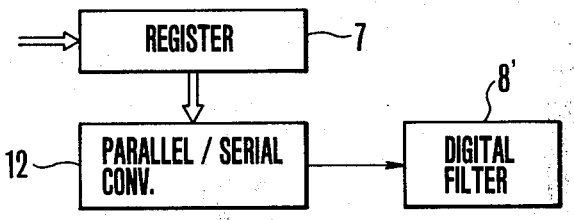
FIG. 3 is a block diagram showing a partial modification of the embodiment shown in FIG. 1.

As above described, according to the electronic musical instrument illustrated in this embodiment, a digital filter is used to impart a frequency characteristic of a fixed formant characteristic, and the time divisioned and multiplexed musical tone signal sampled values which are formed at a high speed in respective tone production channels are synthesized and then processed by a digital filter. Consequently, the digital filter may be a not expensive filter that performs filter processing at a low speed. In addition, it is possible to produce a musical tone of a fixed formant characteristic with a simple construction. Moreover, as it is possible to readily fabricate the digital filter with an integrated circuit, it is possible to make the entire circuit small.

Where a plurality of circuits, each including tone generator 3, accumulator 6, register 7, digital filter 8 and parameter register 9, are connected in parallel, and where a musical tone of different fixed format characteristic is formed and produced in each circuit it is possible to produce richer musical tone. Where a serial data input type digital filter 8 is used, as partially shown in FIG. 3, the output $\Sigma e(t)$ of the register 7 is converted into serial data by a parallel-serial converter 12 and then applied to a serial data input type digital filter 8'.

Figure 4:
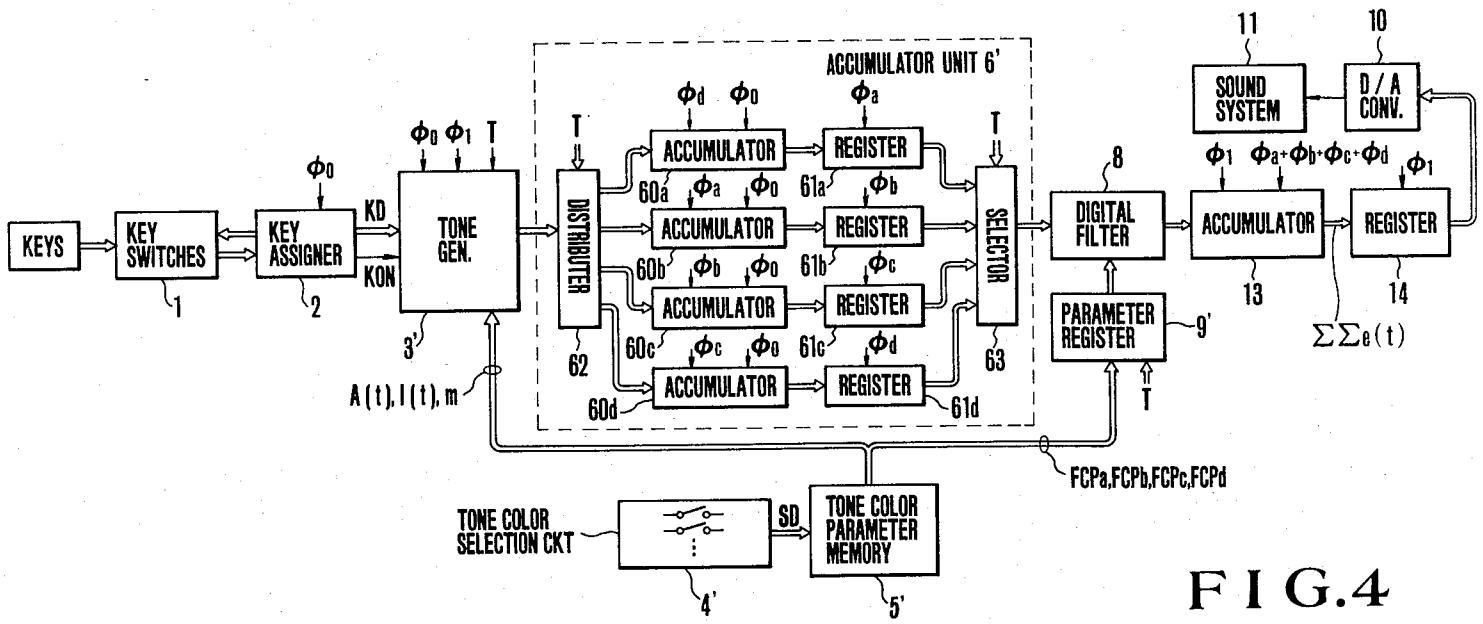
FIG. 4 is a block diagram showing a modification of this invention.
Figure 5:
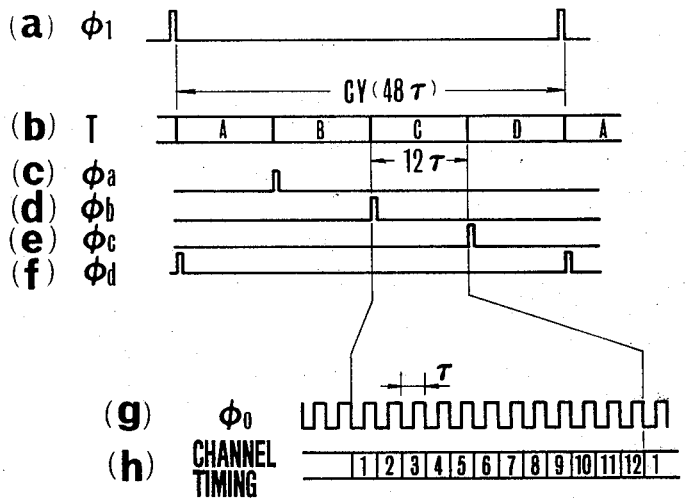
FIG. 5 shows diagrams showing one example of the timing signals utilized in the embodiment shown in FIG. 4.

FIG. 4 is a block diagram showing another embodiment of the electronic musical instrument according to this invention which is constructed to produce a musical tone having four tone colors for each one of a maximum of 12 simultaneously depressed keys. In FIG. 4, a tone generator 3' has 12 tone production channels CH1 through CH12 similar to the embodiment shown in FIG. 1, but in this case since musical tones having four tone colors are produced at the same time, the musical tone signal forming cycle CY is made to be equal to the period 48 times one period $\tau$ of the clock pulse $\phi_0$ and in the musical tone signal forming cycle CY of $48\tau$, each of the tone production channels CH1 through CH12 is used 4 times in an interval A to D equal to $12\tau$ time width units as shown in FIG. 5*b*. In each interval A to D, musical tone signal sampled values having different tone colors are produced. Accordingly, tone color selector 4' of this embodiment is constructed to independently select tone colors of the musical tone signals in each interval A to D, and a tone color memory device 5' is constructed to output informations A(t), I(t), m and FCP used to independently control the tone colors of the musical tone signals formed in respective intervals A to D. As a consequence, the tone generator 3' of this embodiment produces, on a time division basis, musical tone signal sampled values e(t)a, e(t)b, e(t)c and e(t)d regarding 4 tone colors.

The musical tone signal sampled values e(t)a, e(t)b, e(t)c, e(t)d for respective tone colors outputted from a tone generator 3' on the time division basis are supplied to an accumulator 6' which comprises accumulators 60*a*, 60*b*, 60*c* and 60*d* and registers 61*a*, 61*b*, 61*c* and 61*d* corresponding to four tone colors for the purpose of accumulating the sampled values e(t)a through e(t)d for respective tone colors. Furthermore, there are provided a distributor 62 which distributes the sampled values e(t)a through e(t)d of respective tone colors outputted from the tone generator 3', on the time division basis, in respective intervals A through D of the musical tone signal forming cycle CY to accumulators 60*a*, 60*b*, 60*c* and 60*d* corresponding to respective tone colors, and a selector 63 which sequentially derives out accumulated values $\Sigma e(t)a$, $\Sigma e(t)b$, $\Sigma e(t)c$ and $\Sigma e(t)d$ of the musical tone signal sampled values for respective tone colors which are outputted from registers 61*a*, 61*b*, 61*c* and 61*d* corresponding to respective tone colors. The distributor 62 and the selector 63 distributes and selects according to a signal T representing respective intervals A through D of the musical tone signal forming cycle CY. Although the accumulators 60*a* through 60*d* form the accumulated values $\Sigma e(t)a$ through $\Sigma e(t)d$ of the musical tone signal sampled values e(t)a through e(t)d for respective tone colors according to the clock pulse $\phi_0$, the reset timings of these accumulators 60*a* through 60*d* are selected as follows. Thus, since the interval A is assigned to a timing that forms the musical tone signal sampled value e(t)a regarding the first tone color a, the accumulator 60*a* that forms the accumulated value $\Sigma e(t)a$ regarding the first tone color a is set at the time of building up of the clock pulse $\phi_d$ produced at the time of commencing the musical tone signal forming cycle CY as shown in FIG. 5*f*. Further, as the interval B is assigned to the time that forms the musical tone signal sampled value e(t)b regarding the second tone color b, the accumulator 60*b* that forms the accumulated value $\Sigma e(t)b$ regarding the second tone color b is reset when the clock pulse $\phi_a$ generated at the time of commencing the interval B builds up, as shown in FIG. 5*c*. Furthermore, as the interval C is assigned to the timing of forming the musical tone signal sampled value e(t)c regarding the third tone color C, the accumulator 60*c* that forms the accumulated value $\Sigma e(t)c$ regarding the third tone color C is reset at the time of building up of the clock pulse $\phi_b$ generated at the time of commencing the interval C as shown in FIG. 5*d*. Similarly, as the interval D is assigned to the timing that forms the musical tone signal sampled value e(t)d regarding the fourth tone color d, the accumulator 60*d* that forms the accumulated value $\Sigma e(t)d$ regarding the fourth tone color d is reset at the time of building up of the clock pulse $\phi_c$ generated at the time of commencing the interval D as shown in FIG. 5*e*. The data set timings of the registers 61*a* through 61*d* that temporarily store the accumulated values of respective accumulators 60*a* through 60*d* are selected to be the timing of generation of the clock pulse $\phi_a$ by the register 61*a*, the timing of generation of the clock pulse $\phi_b$ by the register 60*b*, the timing of generation of the clock pulse $\phi_c$ by the register 60*c* and the timing of generation of the clock pulse $\phi_d$ by the register 61*d*. Accordingly, when the time divisioned and multiplexed sampled values e(t)a through e(t)d of four tone colors are supplied to the accumulator 6' from the tone generator 3' during the intervals A through D these sampled values would be respectively accumulated in the accumulators 60*a* through 60*d* of corresponding tone color. The accumulated values $\Sigma e(t)a$ through $\Sigma e(t)d$ are temporarily stored in registers 61*a* through 61*d* respectively of corresponding tone color and then derived out one after one by the selector 63 to be supplied to a digital filter 8 on the time division basis.

Figure 6:
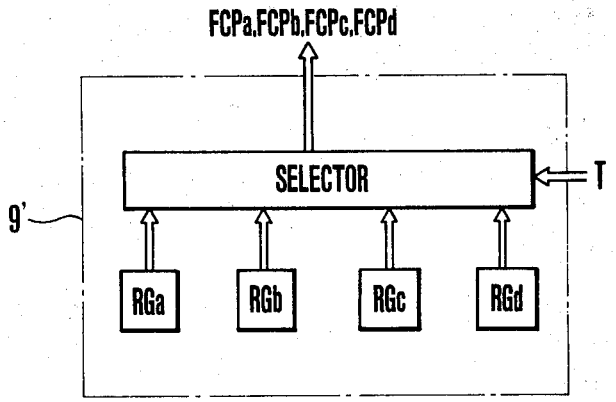
FIGS. 6 and 7 show detailed construction of the parameter register utilized in the embodiment shown in FIG. 4.

Then the digital filter 8 imparts a frequency characteristic of the fixed formant characteristic to the accumulated values $\Sigma e(t)a$ through $\Sigma e(t)d$ of respective tone colors. In this case, the digital filter 8 is supplied, on a time division basis, with a parameter information FCP from the register 9' for setting the filter characteristic in respective intervals corresponding to respective tone colors. More particularly, as shown in FIG. 6, the register 9' is provided with four buffer registers $RG_a$ through $RG_d$ respectively storing parameter informations $FCP_a$ through $FCP_d$ for respective tone colors transferred from the tone color memory device 5'. The information $FCP_a$ through $FCP_d$ stored in these registers $RG_a$ through $RG_d$ are derived out one after one by a selector SEL in each one of the intervals A through D, and the derived out informations are supplied to the digital filter 8. Thus, the digital filter 8 is supplied with the accumulated values Σe(t)a a through Σe(t)d in respective intervals corresponding to the tone colors, and when supplied with the accumulated values Σe(t)a through Σe(t)d corresponding to respective tone colors in respective intervals A through D and the parameter informations $FCP_a$ through $FCP_d$, the digital filter 8 imparts the frequency characteristics of the fixed formant characteristics independently designated by the informations $FCP_a$ through $FCP_d$ of the respective accumulated values Σe(t)a through Σe(t)d.

The accumulated values Σe(t)a through Σe(t)d thus imparted with the fixed formant characteristics are accumulated by an accumulator 13 when the clock pulses $\phi_a$, $\phi_b$, $\phi_c$ and $\phi_d$ are generated. The entire accumulated value ΣΣe(t) is set in a register 14 when the clock pulse $\phi_1$ (see FIG. 5*a*), which determines a musical tone signal forming cycle CY builds up, and then supplied to the digital-analog converter 10 from the register 14. Accordingly, musical tones of four tone colors having the fixed formant characteristic are simultaneously produced from the sound system 11. The entire accumulated values ΣΣe(t) formed by the accumulator 13 is cleared when the clock pulse $\phi_1$ builds down for preparing for the accumulating operation in the next musical tone signal forming cycle CY.

As above described, according to the electronic musical instrument of this embodiment, there are provided four musical tone signal forming circuits and the digital filter 8 is used for respective circuits on a time division basis, to independently impart frequency characteristics of the fixed formant characteristics to the musical tone signals of respective circits and the musical tone signals imparted with the fixed formant characteristics are synthesized and then produced as musical tones. As a consequence, this embodiment too can provide the same novel effects as the embodiment shown in FIG. 1 and moreover can produce musical tones of multiple tone colors having fixed formant characteristics with a simple circuit construction.

Figure 7:
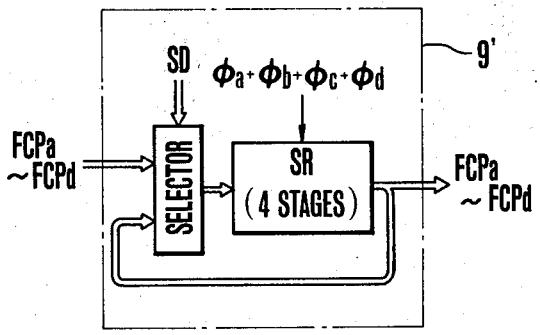

Although in the embodiment shown in FIG. 4 the tone production channels CH1 through CH12 of the tone generator 3' are used four times to form four musical tone signals it is also possible to provide four parallel connected circuits of the tone production channels CH1 through CH12 corresponding to respective musical tone signals, in which case the distributor 62 of the accumulator 6' can be omitted. Furthermore, the parameter register 9' can be constructed as shown in FIG. 7. More particularly, the parameter informations $FCP_a$ through $FCP_d$ of respective tone colors outputted from the tone color parameter memory device 5' are selectively derived out by the selector SEL according to the tone color selection information SD and the selected informations are stored in respective stages of a four stage shift register SR for respective tone color circuits with a logical sum of pulses $\phi_a$, $\phi_b$, $\phi_c$ and $\phi_d$ so as to apply the parameter informations $FCP_a$ to $FCP_d$ to the parameter register 9' in synchronism with respective intervals A through D.

Furthermore, in the embodiment shown in FIG. 4, although the elements (pitch, waveform, and amplitude level) of the musical tone signal and the characteristic of the digital filter 8 were changed for respective tone colors, it is also possible to commonly use the musical tone signal for a plurality of tone colors without changing the musical tone signals for respective tone colors by changing only the characteristic of the digital filter for respective tone colors. Alternatively, the digital filter may be used in common for a plurality of tone colors without changing the characteristic of the digital filter by changing the musical tone signals for different tone colors.

Depending upon the type of the tone colors, the musical tone signals can be supplied directly to the accumulator 13 without passing them through the digital filter 8.

Alternatively, a portion of the musical tone signal can be imparted with a fixed formant characteristic by passing it through a digital filter while the other portion is derived out without passing through the digital filter thus forming musical tone signals corresponding to respective tone colors.

As can be noted from the foregoing description, according to the electronic musical instrument of this invention, a digital filter is used to impart a frequency characteristic of a fixed formant characteristic, and time divisioned and multiplexed musical tone signal sampled values formed at a high speed in respective tone production channels are synthesized and then filtered by the digital filter. For this reason an inexpensive digital filter having a simple construction and can process the synthesized sampled values at a low speed can be used as the digital filter for producing a musical tone having a fixed formant characteristic. In addition, since the digital filter can be fabricated with an integrated circuit and can be used on a time division basis, it is possible to produce a musical tone having multiple tone colors having a fixed formant characteristic with a circuit of small size.

What is claimed is:

1. An electronic musical instrument comprising:

keyboard means having a plurality of keys;

tone color selecting means for selecting a tone color among predetermined tone colors;

tone signal generating means for generating, on a time division basis, musical tone signals corresponding to depressed keys among said plurality of keys, said musical tone signals collectively forming a periodic sequence of sampled values which occurs respectively, each said musical tone signal containing a fundamental component and harmonic components determined by the selected tone color;

accumulating means connected to said tone signal generating means for accumulating the sampled values of said sequence and resetting the accumulated value to a predetermined value after outputting an accumulated musical tone signal represented by said accumulated value once per repetition of said sequence;

digital filtering means connected to said accumulating means for imparting a fixed formant characteristic characterizing said selected tone color to said accumulated musical tone signal; and musical tone forming means for forming a musical tone in accordance with said accumulated musical tone signal.

2. An electronic musical instrument according to 1 wherein said tone signal generating means includes a plurality of tone production channels for producing said musical tone signals.

3. An electronic musical instrument according to claim 1 wherein said musical tone forming means includes a digital-analog converter.

4. An electronic musical instrument according to claim 1 which further includes a parallel/serial converter which is connected in series between an output of said accumulating means and an input of said digital filtering means.

5. An electronic musical instrument according to claim 1 wherein said accumulating means includes a plurality of accumulators, a plurality of registers respectively connected to receive outputs of said accumulators, a distributor for distributing outputs of said tone signal generating means to one from among said plurality of accumulators, and a selector for selectively supplying selected ones of the outputs of said registers to said digital filtering means.

6. An electronic musical instrument according to claim 1 or 5 which further includes a tone color selection circuit for selecting either one of a plurality of tone colors of formant characteristics to produce a tone color selection information, a tone color parameter memory for storing filter characteristic parameter information determined by said formant characteristics and supplying filter characteristic parameter information read out in accordance with said tone color selection information to said digital filtering means.

7. An electronic musical instrument according to claim 6 wherein said tone color parameter memory further stores tone color parameter information and supplies tone color parameter information read out in accordance with said tone color selection information to said tone generating means.

8. An electronic musical instrument according to claim 6 wherein said tone color selection circuit includes a plurality of switches for designating tone colors to be imparted to said musical tone.

9. An electronic musical instrument according to claim 6 wherein said parameter register includes a buffer register circuit for storing parameter informations for respective tone colors transferred from said tone color parameter memory and a selector for deriving out one after one said informations stored in said buffer registers and for supplying derived out informations to said digital filtering means.

10. An electronic musical instrument according to claim 9 wherein said buffer register circuit comprises a plurality of buffer registers.

11. An electronic musical instrument according to claim 9 wherein said buffer register circuit comprises a multiple stage shift register adapted to store outputs of said selector at respective stages thereof.

* * * * *